United States Patent [19]

Makino

[11] 4,308,833

[45] Jan. 5, 1982

[54] CENTRIFUGAL RPM GOVERNOR FOR FUEL INJECTED INTERNAL COMBUSTION ENGINES

[75] Inventor: Niro Makino, Kariya, Japan

[73] Assignee: Nippondenso Co. Ltd., Kariya, Japan

[21] Appl. No.: 79,924

[22] Filed: Sep. 28, 1979

[30] Foreign Application Priority Data

Oct. 13, 1978 [JP] Japan ..... 53-141042[U]

[51] Int. Cl.[3] ..... F02D 1/04

[52] U.S. Cl. ..... 123/368; 123/373; 123/374

[58] Field of Search ..... 123/373, 374, 368, 367, 123/365

[56] References Cited

U.S. PATENT DOCUMENTS

| | | | |
|---|---|---|---|
| 4,064,856 | 12/1977 | Augustin | 123/373 |
| 4,132,206 | 1/1979 | Straubel | 123/374 |
| 4,164,925 | 8/1979 | Maier | 123/374 |
| 4,175,529 | 11/1979 | Geafer | 123/374 |

*Primary Examiner*—Ira S. Lazarus
*Assistant Examiner*—Carl Stuart Miller
*Attorney, Agent, or Firm*—Edwin E. Greigg

[57] ABSTRACT

A centrifugal governor is proposed for fuel injected internal combustion engines, which preferably functions as an idling and a final rpm governor. Preferably, the governor is provided with a cam-guided adaptor apparatus whose influence on the governor movement is removed in order to increase the work capacity of the governor during idling operation. The centrifugal rpm governor includes an intermediate lever connecting a governor sleeve with the control rod of an injection pump. The intermediate lever is additionally actuatable by a setting lever, and an adaptor lever system. The adaptor lever system substantially comprises an adaptor lever disposed approximately parallel to the intermediate lever and cooperating therewith and actuatable by the governor sleeve. The adaptor lever has at its outermost end a cam follower, which is guided on a cam surface of a stop cam for the purpose of limiting the full-load supply quantity. When the setting lever is located in the idling position, the adaptor lever system is separated from the governor sleeve by means of a back-off lever. As a result, the adaptor lever system has no influence on governing during the idling operation. The back-off lever is advantageously connected with the setting lever in a rotationally secure manner and is preferably supported together with a bell crank connecting the adaptor lever with the governor sleeve on a common lever shaft in the governor housing.

6 Claims, 2 Drawing Figures

CENTRIFUGAL RPM GOVERNOR FOR FUEL INJECTED INTERNAL COMBUSTION ENGINES

BACKGROUND OF THE INVENTION

The invention relates to a centrifugal rpm governor for fuel injection internal combustion engines, and in particular to centrifugal rpm governors which adjust the fuel quantity control rod of a fuel injection supply pump. The governor includes flyweights displaceable as a function of engine rpm, a governor sleeve connected to the flyweights for displacement as a function of the displacement of the flyweights, an intermediate lever pivotably connected to the governor sleeve, and connectable to the fuel quantity control rod, a setting lever connected to the intermediate lever for arbitrarily adjusting the intermediate lever, a stop cam defining a cam surface which determines the full-load fuel quantity, and an adaptor lever system having an adaptor lever, actuated by the governor sleeve, which includes a cam follower which contacts the cam surface.

A centrifugal rpm governor, such as that noted above, and provided with an adaptor lever system, is already known (German Offenlegungsschrift—laid open application No. 26 56 261); the corresponding U.S. Pat. No. 4,164,925 issued on Aug. 21, 1979 and is assigned to the assignee of this application. In the known governors, the adaptor lever system must be dragged along with the adjustment member during idling operation as well, that is, when the idling rpm level is being governed. Because of the smaller work capacity of the governor during idling, this can have a disadvantageous effect on the function of the governor during idling. This known rpm governor already includes in its adaptor lever system a bell crank which couples the adaptor lever to the governor sleeve, and this enables a freely selectable increased translation by means of the translation of the bell crank, from the adjustment member path into the pickup path of the cam follower of the adaptor lever.

Friction and inertia forces in these levers can have a disadvantageous effect, however, on the function of the governor during idling.

OBJECTS AND SUMMARY OF THE INVENTION

It is a principal object of this invention to improve the above noted centrifugal rpm governors, and in particular to improve the idling operation thereof.

The improved centrifugal rpm governor according to the invention has the advantage over the prior art in that the adaptor lever system is taken out of engagement with the governor sleeve during idling operation, so that neither the friction forces nor the inertia forces of the adaptor lever system have any influence on the idling operation. As a result, the centrifugal rpm governor according to the invention functions during idling operation in the same manner as a known rpm governor not equipped with a lever and cam controlled adaptor device.

According to an advantageous feature of the invention, the adaptor lever system has a bell crank which couples the adaptor lever with the governor sleeve by means of a transfer element. The bell crank is force-lockingly connected to the transfer element, which in turn is connected to the governor sleeve. As a result, the governor sleeve becomes less susceptible to vibration.

With the back-off lever, a separation of the adaptor lever system from the governor sleeve is attained. The back-off lever is supported on a common shaft with a setting lever and, preferably with the setting lever and the bell crank to achieve thereby a space-saving design.

According to another advantageous feature of the invention, the adaptor lever is provided with a cam follower and this cam follower is maintained in permanent contact with the cam surface of a full-load fuel supply quantity cam.

According to still another advantageous feature of the invention the transfer element is embodied as a tang of a slider which is guided in a coupler portion of the governor sleeve. The tang simultaneously connects the governor sleeve with an intermediate lever of the governor in an articulated manner. In this way further elements between the governor sleeve and the adaptor lever system are not necessary.

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
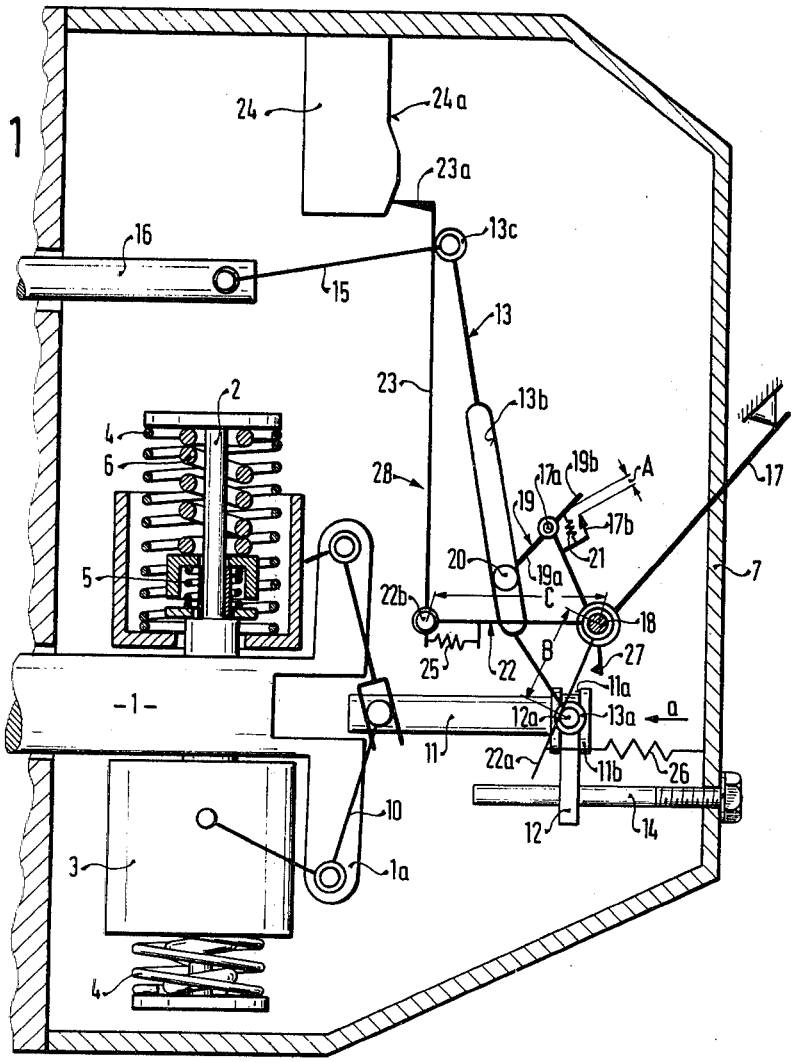
FIG. 1 is a simplified schematic representation of the centrifugal rpm governor according to the invention, which functions as an idling and final rpm governor.
Figure 2:
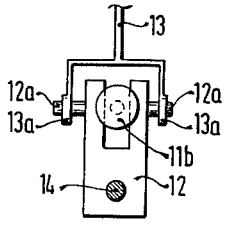
FIG. 2 is a partial horizontal view, looking in the direction of the arrow a of FIG. 1, of the portion of the adjustment member which is provided with a slider.

Turning now to FIG. 1, a flyweight carrier 1*a* is secured on a camshaft 1 within a governor housing 7. Spacer bolts 2 are inserted into this flyweight carrier 1*a*. Flyweights 3 are guided on these spacer bolts 2 with their outward motion caused by centrifugal force acting counter to the force of each of three springs 4, 5 and 6, all of which are prestressed. This assembly of springs comprise an idling spring 4, an adaptor spring 5 and an rpm governing spring 6, each of which come into play in sequence, in a known manner, as the engine rpm increases. The motion of the flyweights 3 is transferred via a bell crank 10 onto a governor sleeve 11 which functions as an adjustment member, which is arranged to move in the axial direction of the camshaft 1. On the right-hand end of the governor sleeve 11, (as viewed in the drawing), there is a coupler 11*b* provided with an annular groove 11*a* and this is arranged to have a slider 12 fitted into it as shown. Supported on a tang 12*a* of the slider 12 is a lower end 13*a*, provided with a bore, of an intermediate lever 13 embodied as a suspension lever or a slotted lever (see FIG. 2). Also shown in FIG. 2 is the fact that the slider 12 in turn is apertured and guided on a guide pin 14 secured within the governor housing 7, as a result of which impermissible tilting and twisting motions of the slider 12 are prevented. The upper end 13*c* of the intermediate lever 13, which is remote from the camshaft 1, is coupled via a link element 15 with a control rod 16 which acts as the fuel supply quantity adjustment member of an injection pump (not shown in further detail). An oblong guide slot 13*b* is provided in the central portion of the intermediate lever 13 and this serves as an adjustment slot. Connected in articulated fashion with one end 17*a* of a setting lever 17, which is pivotable in the governor housing 7 about a lever shaft 18, is a steering lever 19, and a pin 20 which is secured to one end 19*a* of the steering lever 19. The pin 20 engages the oblong guide slot 13*b*. A second end 19*b* of the steering lever 19 is pulled by a spring 21 toward a stop 17*b* which is provided on the setting lever 17 and thus forms a drag lever arrangement which is already known per se.

Also rotatably supported on the lever shaft 18 is a bell crank 22, one lever arm 22*a* of which rests on the left hand side of the tang 12*a* of the sliding contact 12. As shown the arm 22*a* is oriented toward the flyweight 3. The tang 12*a* serves as the transfer member for the adjustment motion of the adjustment or governor sleeve 11. With its other lever arm 22*b*, it is articulatedly connected with an adaptor lever 23, while a cam follower 23*a* embodied on the upper end of the adaptor lever 23 lies opposite a cam surface 24*a* of a stop cam 24 which serves as the full-load stop. In addition, the adaptor lever 23 is disposed approximately parallel to the intermediate lever 13 and lies at the left-hand side opposite the upper end 13*c* of the intermediate lever 13, and is arranged in such a fashion that it comes into effective contact with the intermediate lever 13 only during full-load operation. This is the case when the upper end 13*c* of the intermediate lever 13 which carries the pivoting point for the link element 15 is pressed against the adaptor lever 23, with the setting lever 17 being in the full-load position; this situation is indicated in FIG. 1.

In the vicinity of the connection between the adaptor lever 23 and the bell crank 22, a biasing spring 25 is disposed in such a manner that the cam follower 23*a* is held in permanent contact with the cam surface 24*a*. A further biasing spring 26 is disposed between the governor housing 7 and the first lever arm 22*a* of the bell crank 22 in such a manner that this spring 26 tends to keep the bell crank 22 in contact with the tang 12*a* of the slider 12, which tang serves as the transfer member.

As may be seen more clearly in FIG. 2, the slider 12 is provided with two tangs 12*a*—12*a* and the intermediate lever 13 is embodied as a forked element in the region of its lower end 13*a*, so that tilting and thus increased friction are avoided in the area of this connection between the governor sleeve 11 and the intermediate lever 13.

A back-off lever 27 is connected with the setting lever 17 in a rotationally secured manner. In the illustrated full-load position of the setting lever 17, the back-off lever 27 is at a distance from the bell crank 22, while the bell crank 22 is in contact, via its lever arm 22*a*, with the tang 12*a* of the slider 12. The back-off lever 27 does not contact the first lever arm 22*a* of the bell crank 22 until the setting lever 17 reaches its idling position (not shown), which will be described below. At that time, the back-off lever 27 rotates the bell crank 22 in the clockwise direction, whereupon, in the illustrated inward position of the flyweights 3, there would be no further connection between the bell crank 22 and the slider 12.

The mode of operation of the centrifugal rpm governor according to the invention will now be described.

FIG. 1 shows the state in which the setting lever 17 is in the full-load position and the Diesel engine associated therewith is stopped. Now, when the flyweights 3, as the engine rpm increase, move outward against the resistance of the idling spring 5 and the adaptor spring 6, away from the rotary axis of the camshaft 1 or of the flyweight carrier 1*a*, then the governor sleeve 11 and the slider 12 move toward the left, and the lower end 13*a* of the intermediate lever 13 is also drawn toward the left. At the same time, the steering lever 19 performs a pivoting movement in the clockwise direction, which reduces the distance, designated by the letter A, between the lever arm 19*b* of the steering lever 19 and the stop 17*b*. Together with this movement of the tang 12*a* of the slider 12, the bell crank 22 is rotated clockwise, which lifts the adaptor lever 23 and causes the cam follower 23*a* to slide along the cam surface 24*a*. Because the pivoting point at the upper end 13*c* of the intermediate lever 13 follows the movement of the adaptor lever 23, the position of the control rod 16 at a particular time is determined by the shape of the cam surface 24*a*, as a result of which both a positive and a negative adaptation, and a variable adaptation as well, can be controlled for the full-load supply quantity.

By means of appropriate mutual adaptation of the effective lever arms designated B and C of the bell crank 22, the lever relationship C/B of the bell crank 22 can be fixed in such a manner than when the stroke of the governor sleeve 11 remains fixed, the upward stroke of the adaptor lever 23 is increased with respect to the stroke of the governor sleeve 11, in order to be able sufficiently precisely to control the injection quantity corresponding to the rpm. As a result of this increased translation, it is possible to realize a very complicated adaptation control.

The distance A is fixed in such a way that it becomes zero in the rpm range in which the adaptor springs 5 are fully compressed (that is, after the adaptor stroke has been performed) and in which the rpm control springs 6 then begin the counteract the flyweights 3. Therefore, as the rpm level further increases, the intermediate lever 13 pivots, independently of the adaptor lever 23, about the pin 20 which functions as its momentary point of rotation and thus controls the deregulation movement for limiting the preset highest rpm level.

When the setting lever 17 is now rotated clockwise out of the illustrated full-load position, then the end 17*a* of the setting lever 17 moves toward the right, the pin 20 moves upward in the oblong guide slot 13*b* and, with a simultaneous clockwise rotation of the steering lever 19, the distance A becomes smaller.

When the setting lever 17 is pivoted farther clockwise up to its idling position, then first the intermediate lever 13 is rotated about the tang 12*a*, acting as its momentary point of rotation, by a predetermined amount and is separated from the adaptor lever 23. Because in this operation the back-off lever 27 pushes on the first lever arm 22*a* of the bell crank 22 and rotates the bell crank 22 clockwise, there is no further contact during idling between the tang 12*a* of the slider 12 and the bell crank 22. This uncoupling of the adaptor lever system, designated by reference numeral 28 and serving as an adaptation control, from the adjustment lever 11 which serves as the rpm control means thus makes it possible to prevent a drop in the governor work capacity which is otherwise caused by the frictional resistance and the inertial mass of the moving governor parts. Thus, as the engine rpm increase, the tang 12*a* of the slider 12 is moved toward the left, the intermediate lever 13 is rotated clockwise about the pin 20, and the control rod 16 is moved, via the link element 15, toward the right, that is, in the direction of reducing the fuel quantity. Thus the governor according to the invention functions as both an idling and a final rpm governor.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. In a centrifugal rpm governor for adjusting the fuel quantity control rod of a fuel injection supply pump of an internal combustion engine, said governor including: flyweights displaceable as a function of engine rpm; a governor sleeve connected to the flyweights for displacement as a function of the displacement of the flyweights; an intermediate lever pivotably connected to the governor sleeve, and connectable to the fuel quantity control rod; a setting lever connected to the intermediate lever for arbitrarily adjusting the intermediate lever; a stop cam defining a cam surface, said stop cam determining the full-load fuel quantity; an adaptor lever system having an adaptor lever which includes a cam follower which contacts the cam surface, such adapter lever being coupled by means of a bell crank with the governor sleeve; and a housing to which the stop cam is secured and within which the flyweights, the governor sleeve, the intermediate lever, at least a portion of the setting lever, the stop cam and the adaptor lever system are located, wherein, at full load, the cam follower is guided along the cam surface in order to correct the position of the fuel quantity control rod, and wherein the adaptor lever is disposed opposite the intermediate lever and at least approximately parallel thereto, the improvement comprising:

a back-off lever for separating the adaptor lever system from the governor sleeve when the setting lever is at its idling position, and further comprising:

a transfer element connected with the governor sleeve; and restoring means connected to one lever arm of the bell crank for biasing the lever arm against the transfer element.

2. In the centrifugal rpm governor as defined in claim 1, wherein said lever arm is pushed from the transfer element against the force of the restoring means by the back-off lever when the setting lever is located in its idling position.

3. In the centrifugal rpm governor as defined in claim 1, wherein the back-off lever and the setting lever are mounted in the housing for common rotation by a lever shaft.

4. In the centrifugal rpm governor as defined in claim 1, wherein the back-off lever, the setting lever and the bell crank are mounted in the housing for common rotation by a lever shaft.

5. In the centrifugal rpm governor as defined in claim 1, the improvement further comprising:

a biasing spring connected to the adaptor lever and to the other lever arm of the bell crank, such that the cam follower permanently contacts the cam surface.

6. In the centrifugal rpm governor as defined in claim 1, the improvement further comprising:

a slider, wherein the governor sleeve includes a coupler which guides the slider, wherein the slider includes a tang which serves as the transfer element, and wherein the tang simultaneously connects the intermediate lever with the governor sleeve.

* * * * *